US005575640A

United States Patent [19]

Fenn et al.

[11] Patent Number: 5,575,640

[45] Date of Patent: Nov. 19, 1996

[54] BURNER FOR GAS BURNING APPARATUS

[75] Inventors: Gordon W. Fenn, Brevard, N.C.; Myeong C. Park, Kyung Ki-Do, Rep. of Korea

[73] Assignee: Frontier, Inc., Ann Arbor, Mich.

[21] Appl. No.: 482,833

[22] Filed: Jun. 7, 1995

[51] Int. Cl.[6] ..... F23D 14/62

[52] U.S. Cl. ..... 431/354; 431/182; 431/328; 431/350

[58] Field of Search ..... 431/350, 354, 431/353, 7, 328, 326, 327, 182, 183, 184; 122/367.1, 367.3, 19, 161; 126/350 R, 351, 373, 374

[56] References Cited

U.S. PATENT DOCUMENTS

| | | | |
|---|---|---|---|
| 4,679,528 | 7/1987 | Krans et al. | 122/367.3 |
| 4,793,800 | 12/1988 | Vallett | 431/328 |
| 4,813,396 | 3/1989 | Sargeant et al. | 431/7 |
| 5,171,144 | 12/1992 | Gerstmann et al. | 431/328 |
| 5,311,843 | 5/1994 | Stuart | 122/367.3 |

*Primary Examiner*—James C. Yeung

*Attorney, Agent, or Firm*—George L. Boller

[57] ABSTRACT

A burner for a gas burning apparatus is disclosed including: a swirl plate in which a plurality of mixing pipe seats having through-holes are formed at predetermined intervals on the same circumference of the central portion; a lowest flame holder having a plurality of flame holes on the sides, and in which mixing pipe seats one fewer than the number of the mixing pipe seats of the swirl plate are formed; a plurality of intermediate flame holders on whose sides a plurality of flame holes are formed, and in which mixing pipe seats one fewer than the number of the mixing pipe seats of the lower flame holder are formed; a highest flame holder on whose sides a plurality of flame holes are formed; mixing pipes interposed between corresponding upper and lower mixing pipe seats of the swirl plate and lowest flame holder, and between corresponding upper and lower mixing pipe seats of the lowest flame holder and intermediate flame holders stacked thereon; a gas chamber spaced apart from the swirl plate with a plurality of spacers; a plurality of nozzles installed on the upper wall of the gas chamber and on the corresponding position to the mixing pipe seats of the swirl plate located thereabove; and an opening/closing valve for opening/closing a plurality of nozzles.

5 Claims, 3 Drawing Sheets

BURNER FOR GAS BURNING APPARATUS

BACKGROUND OF THE INVENTION

The present invention relates to a burner for a gas burning apparatus, and more particularly, to a burner for a gas burning apparatus for easily changing the maximum amount of gas combustion of the burner according to the volume of the gas burning apparatus.

As shown in FIG. 1, a general gas burning apparatus (gas quick water heater) employs a direct heating method in which cold water supplied via a water supply pipe 1 is heated by flames of a burner 3 located under a heat exchanging tube 2 while passing through it, and the heated water is discharged through an outflow pipe 4.

In the conventional burner 3, a plurality of burner fins are formed in combination according to the capacity of the burner. Through a gas valve 7 having a knob 6, and a nozzle (not shown), gas is injected to the plurality of burner fins and burned via gas ejection holes formed on the individual burner fins. An ignition rod 5 is installed around the gas ejection holes.

In order to operate burner 3, knob 6 is used to open gas valve 7 so that gas is injected to the individual burner fins through the nozzle (not shown) and burned through the gas ejection holes formed on the individual burner fins.

Since, according to the method of directly heating the heat exchanging tube, the conventional burner is installed under the heat exchanging tube and gas is burned through the numerous gas ejection holes whose top is opened on the same plane on which a plurality of burner fins are combined, this causes imperfect combustion due to the fact that oxides from corrosion of the heat exchanging tube and products of the burned gas fall to the burner fins to stop up the gas ejection holes. In addition, a plurality of burner fins are combined to increase the capacity of the burner, unnecessarily swelling the size of the burner.

SUMMARY OF THE INVENTION

Therefore, it is an object of the present invention to provide an indirect heating burner for a gas burning apparatus in which the capacity of a burner can be controlled regardless of the capacity of the burning apparatus, the gas ejection holes of the burner are not stopped up even though products of burned gas fall, and the corrosion of the heat exchanging tube is prevented.

It is another object of the present invention to provide a burner for a gas burning apparatus for easily changing the maximum amount of gas combustion according to the capacity of the burning apparatus.

To accomplish the objects of the present invention, there is provided a burner for a gas burning apparatus comprising: a swirl plate in which a plurality of mixing pipe seats having through-holes are formed at predetermined intervals on the same circumference of the central portion, and a plurality of air suction holes are formed on the periphery; a lowest flame holder installed on the upper center of the swirl plate and opened from the bottom and having a plurality of flame holes on the sides, and in which on the upper wall corresponding to the mixing pipe seats of the swirl plate, mixing pipe seats one fewer than the number of the mixing pipe seats of the swirl plate are formed; a plurality of intermediate flame holders which are stacked on the lowest flame holder, whose bottoms are opened, on whose sides a plurality of flame holes are formed, and in which on the upper wall corresponding to the mixing pipe seats of a lower flame holder, mixing pipe seats one fewer than the number of the mixing pipe seats of the lower flame holder are formed; a highest flame holder which is installed on the intermediate flame holders, whose bottom is opened, on whose sides a plurality of flame holes are formed, and whose top wall is closed; mixing pipes interposed between corresponding upper and lower mixing pipe seats of the swirl plate and lowest flame holder, and between corresponding upper and lower mixing pipe seats of the lowest flame holder and intermediate flame holders stacked thereon; a gas chamber installed under the swirl plate and spaced apart from the swirl plate with a plurality of spacers by a predetermined interval; a plurality of nozzles installed on the upper wall of the gas chamber and on the corresponding position to the mixing pipe seats of the swirl plate located thereabove; and an opening/closing valve for opening/closing a plurality of nozzles installed on the lower wall of the gas chamber.

BRIEF DESCRIPTION OF THE ATTACHED DRAWINGS

DETAILED DESCRIPTION OF THE INVENTION

Figure 1:
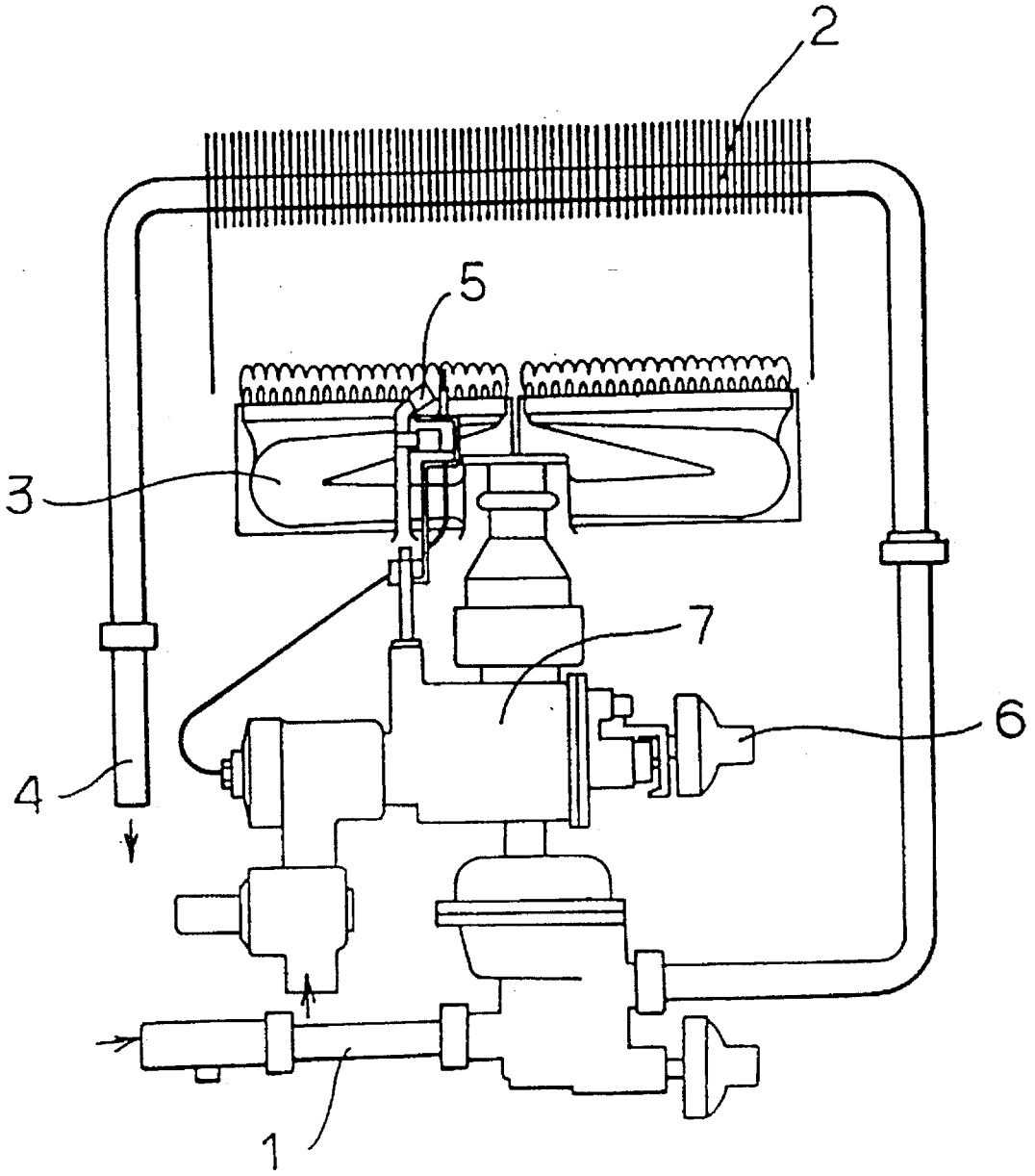
FIG.1 PRIOR ART
FIG. 1 is a schematic configuration view of a conventional burner for a gas burning apparatus (gas quick water heater)
Figure 2:
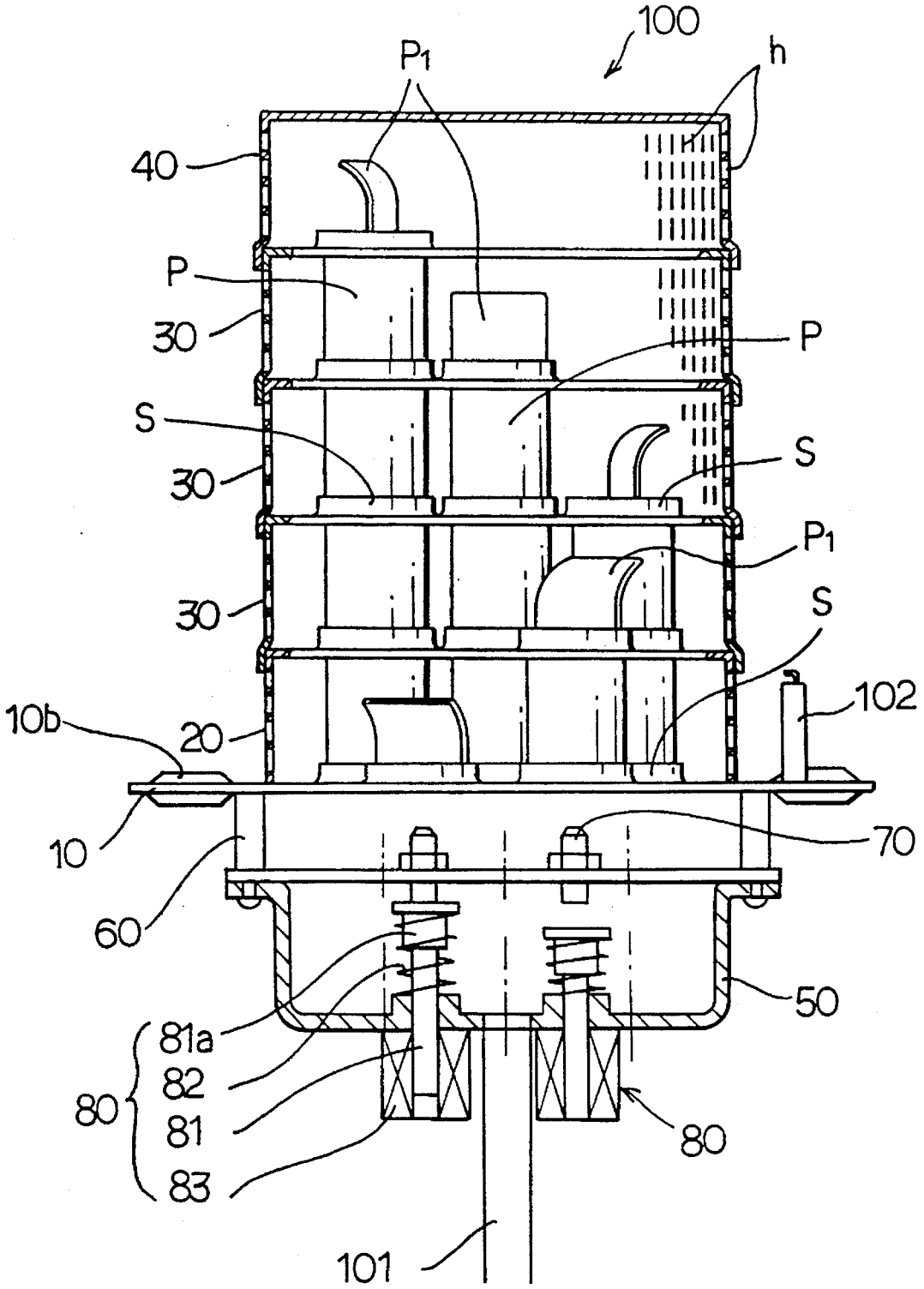
FIG. 2 is a partially cutaway front view of a burner of the present invention.
Figure 3:
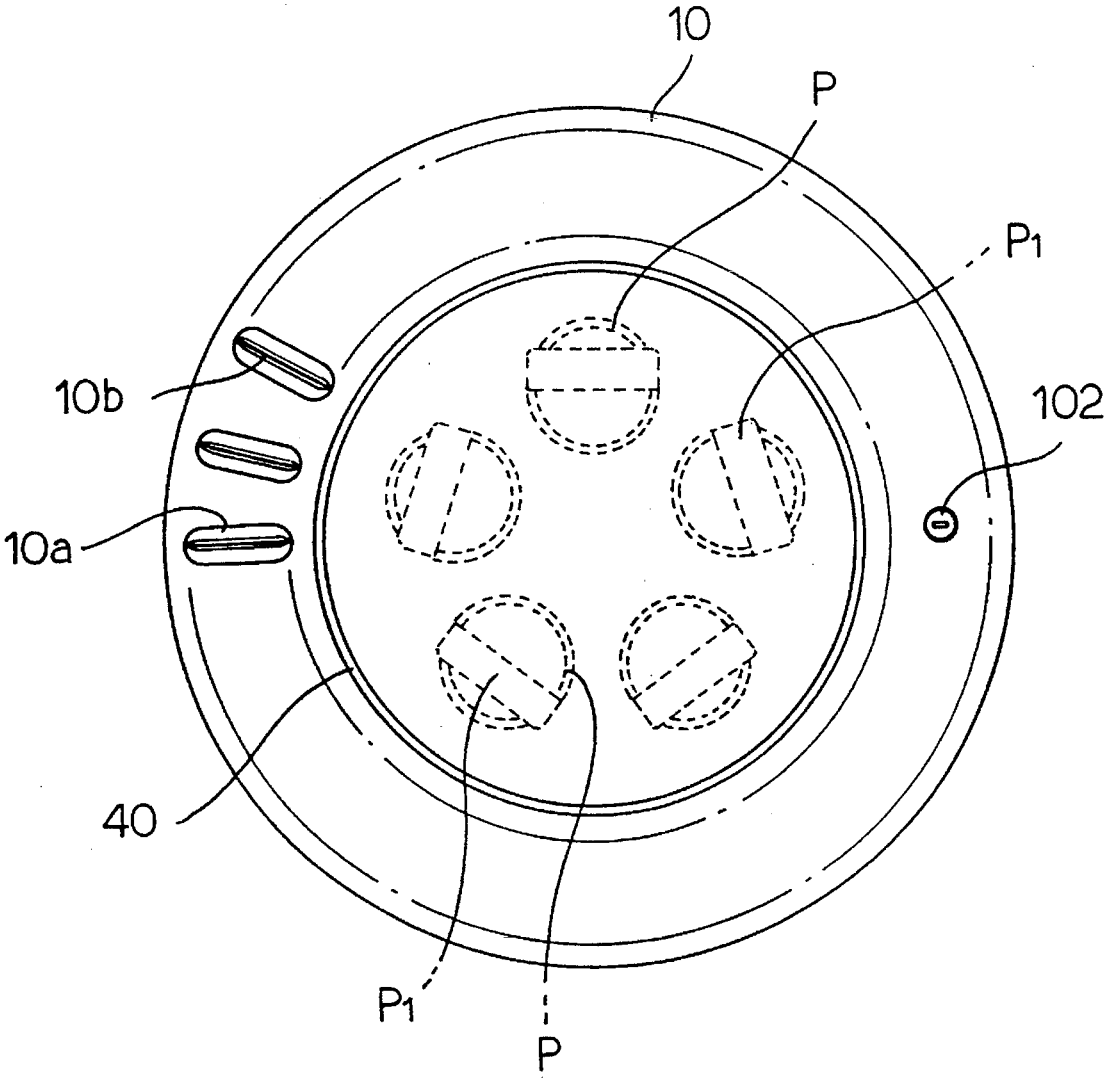
FIG. 3 is a schematic plan view of the burner of the present invention.

Referring to FIGS. 2 and 3, a burner 100 of the present invention is installed in a combustion barrel of a gas burning apparatus for the purpose of burning gas. This burner is employed in an indirect heating burning apparatus which heats a heat exchanging tube by high-temperature combustion gas.

In a swirl plate 10 installed at the middle height of the cylinder of the burning apparatus, a plurality of mixing pipe seats S having through-holes are formed at predetermined intervals on the same circumference of the central portion. A plurality of air suction holes 10*a* are formed around the swirl plate. Guides 10*b* for rotating a flow of air in a-whirl form are formed in air suction holes 10*a*.

A lowest flame holder 20 installed on the upper center of swirl plate 10 is opened from the bottom. This holder has a plurality of flame holes h on the sides. On the upper wall corresponding to mixing pipe seats S of swirl plate 10, mixing pipe seats S one fewer than the number of the mixing pipe seats of swirl plate 10 are formed.

A plurality of intermediate flame holders 30 stacked on lowest flame holder 20 are also opened from the bottom. A plurality of flame holes h are formed on the sides. On the upper wall corresponding to mixing pipe seats S of a lower flame holder, mixing pipe seats S one fewer than the number of the mixing pipe seats of the lower flame holder are formed. The highest flame holder of intermediate flame holders 30 has one mixing pipe seat S.

Of mixing pipe seats S of swirl plate 10, lowest flame holder 20 and intermediate flame holders 30, on mixing pipe seats S on which mixing pipe P is not put, deflection plates P1 are attached to deflect outward part of gas discharged through mixing pipe P.

A highest flame holder 40 installed on intermediate flame holders 30 is opened from the bottom. A plurality of flame holes h are formed on the sides. The top wall of this holder is closed.

The lower ends of all the intermediate flame holders 30 and highest flame holder 40 are extended outward to be coupled to the upper ends of lower flame holders.

Between corresponding upper and lower mixing pipe seats S of swirl plate 10 and lowest flame holder 20, and between corresponding upper and lower mixing pipe seats S of lowest flame holder 20 and intermediate flame holders 30 stacked thereon, mixing pipe P for mixing gas and air are interposed.

Under swirl plate 10, a gas chamber 50 is installed being spaced apart from swirl plate 10 with a plurality of spacers 60 by a predetermined interval. On the upper wall of gas chamber 50, a nozzle for ejecting gas is installed to a position corresponding to mixing pipe seats S of swirl plate 10 located thereabove.

An opening/closing valve 80 for opening/closing nozzle 70 is installed on the lower wall of gas chamber 50. Opening/closing valve 80 is slidable to the lower wall of gas chamber 50, having a plunger 81 with an opening/closing hole 81*a* at the top end, a compression spring 82 for applying a upward force to plunger 81, and a solenoid 83 installed on the outer surface of the lower wall of gas chamber 50 and around plunger 81.

A gas supply pipe 101 is connected to the center of the lower wall of gas chamber 50. An ignition rod 102 is installed around lowest flame holder 20.

The operation of the burner of the present invention constructed as above will be explained below.

When the gas burning apparatus operates, gas supplied through a gas valve (not shown) is temporarily stored in gas chamber 50 through gas supply pipe 101. When burner 100 does not operate, opening/closing valve 80 closes nozzle 70 by compression spring 82, and gas stays in gas chamber 50.

As the burning apparatus operates, plunger 81 of opening/closing valve 80 moves downward by the operation of solenoid 83 to open nozzle 70. Gas is injected through opened nozzle 70, and enters mixing pipe P located thereabove along with air. Gas is mixed with air while flowing inside mixing pipe P.

As shown in FIG. 2, since mixing pipe P of the respective flame holders are connected up and down, gas flows into the respective flame holders through the through-holes of one mixing pipe seat S. When gas flows into the respective flame holders through the through-holes of mixing pipe seats S, part of gas is deflected outward by deflection plate P1 attached to the through-holes. This allows the gas to be uniformly supplied within the flame holders.

As the burning apparatus operates, gas is ejected outside the flame holders through the flame holes h of the respective flame holders, and burned by the ignition of ignition rod 102. The gas is burned with air coming through air suction holes 10*a* of swirl plate 10. The burned gas flows upward in a whirl form to indirectly heat the heat exchanging tube.

The number of nozzles 70 opened in using the burning apparatus varies with the amount of combustion according to user's demand. If the amount of combustion of the burning apparatus must be great, many nozzles 70 are opened to increase the amount of gas combustion. If not, few nozzles 70 are opened to decrease the amount of gas combustion.

In this invention, the burner is able to easily change the maximum amount of gas combustion according to the capacity of a burning apparatus.

For instance, if the burner of the present invention is installed in a burning apparatus having a one-level-lower capacity, mixing pipes P for inducing gas into the highest flame holder 40 all are removed, the highest flame holder 40 is installed instead of the highest intermediate flame holder 30, nozzle 70 and opening/closing valve 30 corresponding to the removed mixing pipes P are removed, and their installation holes are stopped up. This facilitates the manufacturing of a burner suitable for a burning apparatus of one-level-lower capacity.

The burner of the present invention is easily changed into a burner for generating the maximum amount of gas combustion suitable for burner apparatuses of a variety of capacities.

The burner of the present invention is suitable for a gas burning apparatus for indirectly heating a heat exchanger by combustion gas, without flames coming into direct contact with a heat exchanging tube. With this burner, gas is uniformly supplied within flame holders to increase combustion efficiency. Further, this invention can be easily modified into appropriate forms according to the capacity of burning apparatuses.

What is claimed is:

1. A burner for a gas burning apparatus comprising:

a swirl plate comprising a central portion surrounded by a periphery and having an upper surface and a lower surface, in which said central portion of said swirl plate comprises a plurality of mixing pipes seats at predetermined circumferential intervals around the central portion, and said periphery comprises a plurality of air suction holes at circumferential intervals around the periphery;

each of said mixing pipe seats comprising a through-hole extending between said upper and lower surfaces of said top wall;

a stack of flame holders comprising a lowest flame holder installed on the upper surface of said swirl plate and comprising a side wall and a top wall and being open at the bottom; said side wall comprising a plurality of flames holes, and in which said top wall comprises mixing pipe seats one fewer in number than the number of said mixing pipe seats of said swirl plate;

said stack further comprising a plurality of further flame holders which are stacked on said lowest flame holder, and each of which comprises a side wall and a top wall cooperatively bounding an interior space that is open at the bottom, said side walls of said further flame holders comprising a plurality of flame holes, and in which the top wall of each further flame holder comprises mixing pipe seats one fewer in number than the number of mixing pipe seats in the top wall of the immediately underlying flame holder, each mixing pipe seat comprising a through-hole extending between the upper and lower surfaces of the top wall of the corresponding flame holder;

one of said plurality of further flame holders being a highest flame holder whose top wall is closed;

mixing pipes interposed between each of the mixing pipe seats of said top wall of said lowest flame holder and a corresponding mixing pipe seat in said swirl plate, and between each of the mixing pipe seats in the top wall of each of said further flame holders, except for the closed top wall of the highest flame holder, and a corresponding mixing pipe of the top wall of an immediately underlying flame holder;

a gas chamber installed under said swirl plate and spaced apart from said swirl plate with a plurality of spacers by a predetermined interval, said gas chamber comprising an upper wall;

a plurality or nozzles installed on the upper wall of said gas chamber, each in a corresponding position below said swirl plate to direct gas to said mixing pipe seats of said swirl plate located thereabove; and an opening/closing valve for opening/closing each of said plurality of nozzles;

whereby each valve controls the conveyance of gas from said gas chamber to a respective interior space of a respective flame holder.

2. A burner for a gas burning apparatus as claimed in claim 1, wherein each mixing pipe seat of said swirl plate and of said flame holders, lacking a mixing pipe thereon, comprises a deflection plate attached thereto to deflect outward part of the gas conveyed to it.

3. A burner for a gas burning apparatus as claimed in claim 1, wherein said gas chamber comprises a lower wall, and each said opening/closing valve is mounted on the lower wall of said gas chamber, having a plunger with a top end for opening and closing a corresponding nozzle, a compression spring for applying a upward force to each said plunger, and a solenoid installed on an outer surface of the lower wall of said gas chamber and around each said plunger.

4. A burner for a gas burning apparatus as claimed in claim 1, wherein guides for rotating a flow of air passing through said air suction holes in a whirl form are formed in said swirl plate.

5. A burner for a gas burning apparatus as claimed in claim 1, wherein the open bottoms of said flame holders, except for the lowest flame holder, are extended outward to seat their respective flame holder on an immediately underlying flame holder, and the open bottom of the lowest flame holder is extended outward to seat the lowest flame holder on said swirl plate.

* * * * *